US009655431B2

(12) United States Patent
Ham

(10) Patent No.: US 9,655,431 B2
(45) Date of Patent: May 23, 2017

(54) COSMETIC CONTAINER

(71) Applicant: ICETEC INC., Seoul (KR)

(72) Inventor: Hyeonggil Ham, Seoul (KR)

(73) Assignee: ICETEC INC., Seoul (KR)

( * ) Notice: Subject to any disclaimer, the term of this patent is extended or adjusted under 35 U.S.C. 154(b) by 0 days.

(21) Appl. No.: 14/647,399

(22) PCT Filed: Nov. 28, 2013

(86) PCT No.: PCT/KR2013/010897

§ 371 (c)(1),
(2) Date: May 26, 2015

(87) PCT Pub. No.: WO2014/084623

PCT Pub. Date: Jun. 5, 2014

(65) Prior Publication Data

US 2015/0305474 A1 Oct. 29, 2015

(30) Foreign Application Priority Data

Nov. 28, 2012 (KR) ..... 10-2012-0136205

(51) Int. Cl.
*B67D 7/80* (2010.01)
*A45D 40/00* (2006.01)
(Continued)

(52) U.S. Cl.
CPC ..... *A45D 40/0075* (2013.01); *A45D 34/00* (2013.01); *A45D 40/00* (2013.01);
(Continued)

(58) Field of Classification Search
CPC .... A45D 40/0075; A45D 40/00; A45D 34/00; A45D 2040/0006; A45D 2200/155;
(Continued)

(56) References Cited

U.S. PATENT DOCUMENTS 3,543,965 A * 12/1970 Lehmann ..... B65D 83/682
137/625.12
3,550,813 A * 12/1970 Lehmann ..... B65D 83/682
137/605

(Continued)

FOREIGN PATENT DOCUMENTS

KR 20040064013 A * 7/2004
KR 1020040064013 7/2004
KR 100854966 8/2008

OTHER PUBLICATIONS

KR20040064013—English Translation Apr. 2016.*

*Primary Examiner* — J. Casimer Jacyna
*Assistant Examiner* — Benjamin R Shaw
(74) *Attorney, Agent, or Firm* — Duane Morris LLP; J. Rodman Steele, Jr.; Gregory M. Lefkowitz

(57) ABSTRACT

Provided is a cosmetics container. The cosmetics container (100) according to this embodiment includes a first container (120) configured to discharge a predetermined amount of cosmetics by a pressing motion, a second container (130) configured to discharge a predetermined amount of coolant by a pressing motion, a container (110) including the first container (120) and the second container (130) therein, a cooler (140), which includes a cooling pipe (141) connected to the first container (120) and allows the cosmetics to move therein and a cooling channel (143) formed to surround the cooling pipe (141) and connected to the second container (130) so that the coolant in the cooling channel (143) is evaporated while moving along an outer surface of the cooling pipe (141) to cool the cosmetics, and a pushing member (150) provided at one side of the container (110), wherein when the pushing member (150) is pressed to a predetermined depth (T), the coolant discharges from the second container (130) and moves to the cooling channel (143), and when the pushing member (150) is pressed over
(Continued)

the predetermined depth (T), the cosmetics discharges from the first container (120) and moves to the cooling pipe (141), wherein the cooling pipe (141) and the cooling channel (143) extend on a plane perpendicular to a vertical direction of the container (110).

8 Claims, 7 Drawing Sheets

(51) Int. Cl.
*A45D 34/00* (2006.01)
*B05B 7/12* (2006.01)
*B05B 11/00* (2006.01)
*B65D 83/54* (2006.01)

(52) U.S. Cl.
CPC ..... *B05B 7/1245* (2013.01); *B05B 11/0002* (2013.01); *B65D 83/54* (2013.01); *A45D 2040/0006* (2013.01); *A45D 2200/155* (2013.01); *B05B 11/3069* (2013.01)

(58) Field of Classification Search
CPC ..... B65D 83/14; B65D 81/18; A47B 31/02; F25D 3/08; F25D 3/107; F25D 3/14; A47J 41/0038; A47J 42/54
USPC ..... 222/145.1, 145.7, 145.8, 321.1, 321.2, 222/146.6, 280, 252; 62/371, 457.1, 62/457.9, 60
See application file for complete search history.

(56) References Cited

U.S. PATENT DOCUMENTS

| | | | | |
|---|---|---|---|---|
| 4,584,847 | A | 4/1986 | Martello et al. | |
| 4,773,562 | A * | 9/1988 | Gueret | A45D 40/24 222/135 |
| 4,979,647 | A | 12/1990 | Hassell | |
| 5,042,693 | A * | 8/1991 | De Luca | B67D 3/0029 141/284 |
| 6,907,750 | B2 * | 6/2005 | Suh | A45D 34/00 62/371 |
| 2005/0005628 | A1 * | 1/2005 | Suh | A45D 34/00 62/371 |
| 2015/0265821 | A1 * | 9/2015 | Shi | A61B 17/00491 604/289 |

* cited by examiner

COSMETIC CONTAINER

CROSS-REFERENCE TO RELATED APPLICATIONS

This application is a §371 national stage entry of International Application No. PCT/KR2013/010897, filed Nov. 28, 2013, which claims priority to South Korean Patent Application No. 10-2012-0136205 filed Nov. 28, 2012, the entire contents of which are incorporated herein by reference.

TECHNICAL FIELD

The present disclosure relates to a cosmetics container.

BACKGROUND ART

In the past, cosmetics have been focused on its components, and a cosmetics container has been focused on its appearance. However, in these days, as emotional consumers who consider convenience and feeling in use are increasing, a temperature of cosmetics is also considered in addition to components and a container of the cosmetics.

In particular, if cosmetics are used in a cooled state, this may give moist and cool feeling to a user and also contracts pores and tenses the skin to give elasticity and moisture to the skin. Therefore, a cosmetics refrigerator for cooling cosmetics has been recently developed.

However, as disclosed in KR10-0854966 B1, the cosmetics refrigerator has a complicated configuration including a cooling fan, a cooling body, heat emitting pins, a heat emitting body and so on, which demands a great manufacture cost. Also, the cosmetics refrigerator has bad portability since it cannot be used without electric power. In addition, in case of cream-type cosmetics, oil components may be separated when being stored in the cosmetics refrigerator. Moreover, if the cosmetics container stored in the cosmetics refrigerator is taken out for use, surface condensation occurs at the outer portion of the cosmetics container at normal temperature.

In addition to the cosmetics refrigerator described above, a technique for adding a cooling component to cool cosmetics has been developed. However, the cooling component added to cosmetics just gives a feeling of refreshment, but the temperature of the cosmetics is not lowered.

In addition, a technique for mixing a coolant spray with cosmetics has also been developed. However, since the coolant is used as a spray, the coolant is mixed with cosmetics, and thus the skin of a user inevitably comes into contact with the coolant. In addition, the temperature of the sprayed coolant cannot be controlled, and too cold cosmetics may give adverse effects to the skin.

DISCLOSURE

Technical Problem

The present disclosure is directed to providing a cosmetics container, which may give excellent cooling performance without any separate standby time, by moving a coolant to a cooling channel and then moving cosmetics to a cooling pipe for cooling.

Technical Solution

In one general aspect, the present disclosure provides a cosmetics container, which includes: a first container configured to discharge a predetermined amount of cosmetics by a pressing motion; a second container configured to discharge a predetermined amount of coolant by a pressing motion; a container configured to include the first container and the second container therein; a cooler, which includes a cooling pipe connected to the first container and allows the cosmetics to move therein, and a cooling channel formed to surround the cooling pipe and connected to the second container, so that the coolant in the cooling channel is evaporated while moving along an outer surface of the cooling pipe to cool the cosmetics; and a pushing member provided at one side of the container, wherein when the pushing member is pressed to a predetermined depth, the coolant discharges from the second container and moves to the cooling channel, and when the pushing member is pressed over the predetermined depth, the cosmetics discharges from the first container and moves to the cooling pipe, wherein the cooling pipe and the cooling channel extend on a plane perpendicular to a vertical direction of the container.

In addition, the cosmetics container according to an embodiment of the present disclosure may further include: a first discharging member provided at the first container to discharge the cosmetics by a pressing motion; and a first pressing unit spaced apart from the first discharging member by a predetermined interval and configured to press the first discharging member when the pushing member is pressed over the predetermined depth so that the cosmetics discharges.

In addition, the cosmetics container according to an embodiment of the present disclosure may further include: a second discharging member provided at the second container to discharge the coolant by a pressing motion; and a second pressing unit connected to the second discharging member and configured to press the second discharging member when the pushing member is pressed so that the coolant discharges.

In addition, in the cosmetics container according to an embodiment of the present disclosure, the cooling channel may extend from one end connected to the second container to a predetermined point, and after the predetermined point, the cooling channel may extend to surround the cooling pipe.

In addition, the cosmetics container according to an embodiment of the present disclosure may further include a cooling gas guiding pipe extending from one end of the cooling channel to the predetermined point and having a diameter smaller than the cooling channel to prevent the coolant from being evaporated till the predetermined point.

In addition, in the cosmetics container according to an embodiment of the present disclosure, a direction in which the cosmetics moves in the cooling pipe may be opposite to a direction in which the coolant moves in the cooling channel.

In addition, in the cosmetics container according to an embodiment of the present disclosure, the cooling channel may be formed by patterning so that the cooler is caved in.

In addition, in the cosmetics container according to an embodiment of the present disclosure, the cooler may be formed by disposing two synthetic resin plates to face each other.

In addition, in the cosmetics container according to an embodiment of the present disclosure, the cooling pipe and the cooling channel may have at least one bent portion.

Features and advantages of the present disclosure may be understood more clearly from the following detailed description.

Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Advantageous Effects

According to the present disclosure, since a coolant moves to a cooling channel and then cosmetics moves to a cooling pipe for cooling, it is possible to give excellent cooling performance without any separate standby time.

In addition, according to the present disclosure, since the cooling pipe through which the cosmetics moves and the cooling channel through which the coolant moves extend on a plane perpendicular to a vertical direction of the container, the cosmetics container may have a compact design.

In addition, according to the present disclosure, a cooling gas guiding pipe is provided so that the coolant moves in a liquid state to a predetermined point where the coolant encounters the cooling pipe, which may prevent the coolant from being evaporated before encountering the cooling pipe and also enhance the cooling performance further.

| Reference Symbols |
|---|
| 100: cosmetics container |
| 110: container |
| 115: inner shoulder |
| 117: outer shoulder |
| 120: first container |
| 121: first discharging member |
| 122: first cylinder |
| 123: ball |
| 124: cosmetics inlet tube |
| 125: first spring |
| 126: cosmetics outlet tube |
| 130: second container |
| 131: second discharging member |
| 132: second cylinder |
| 133: load |
| 134: coolant inlet tube |
| 135: second spring |
| 136: coolant outlet tube |
| 136a: discharge hole |
| 137: rubber |
| 140: cooler |
| 140a, 140b: synthetic resin plate |
| 141: cooling pipe |
| 143: cooling channel |
| 145: cooling gas guiding pipe |
| 149: exhaust tip |
| 150: pushing member |
| 151: first pressing unit |
| 153: second pressing unit |

-continued

| Reference Symbols |
|---|
| 155: elastic member |
| A: one end of the coolant channel |
| B: predetermined point |
| T: predetermined depth |
| I: is predetermined interval |

BEST MODE

Objects, specific advantages and new features of the present disclosure will become clearer from the following detailed description and embodiments associated with the accompanying drawings. In this specification, when reference symbols are endowed to components of each figure, it should be noted that like reference symbols denote like elements through several figures. In addition, the terms "first", "second" or the like are just used for distinguishing any component from another component, and the component is not limited by these terms. Hereinafter, in the description, details of well-known features and techniques may be omitted to avoid unnecessarily obscuring the presented embodiments.

Hereinafter, a preferred embodiment of the present disclosure will be described in detail with reference to the accompanying drawings.

Figure 1:
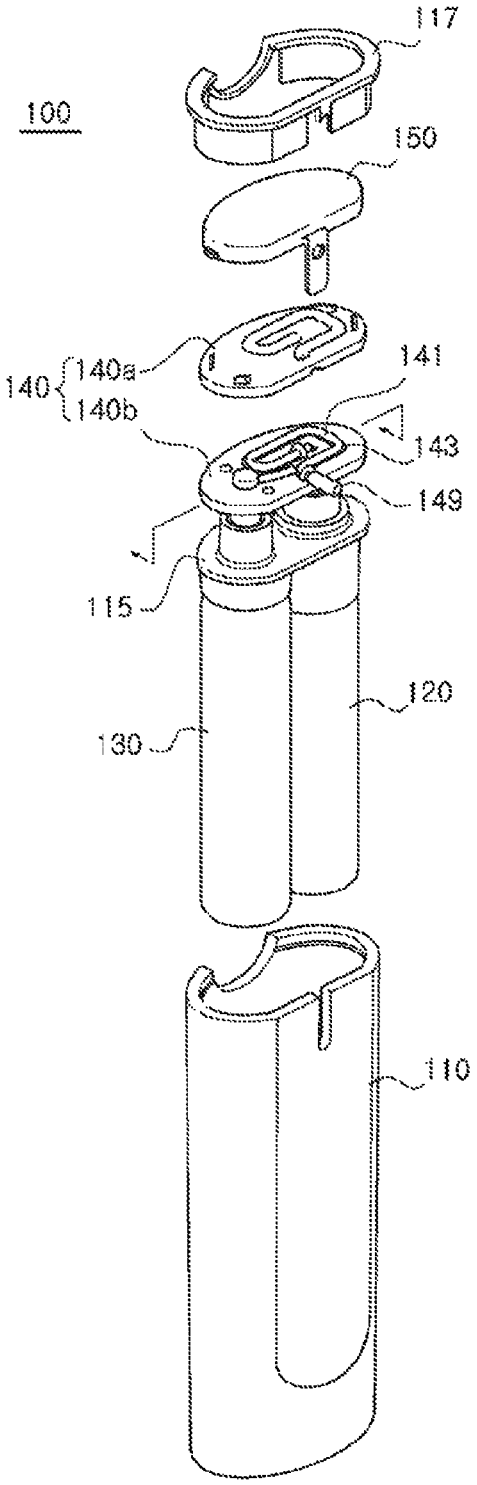
FIG. 1 is an exploded perspective view showing a cosmetics container according to an embodiment of the present disclosure.
Figure 2:
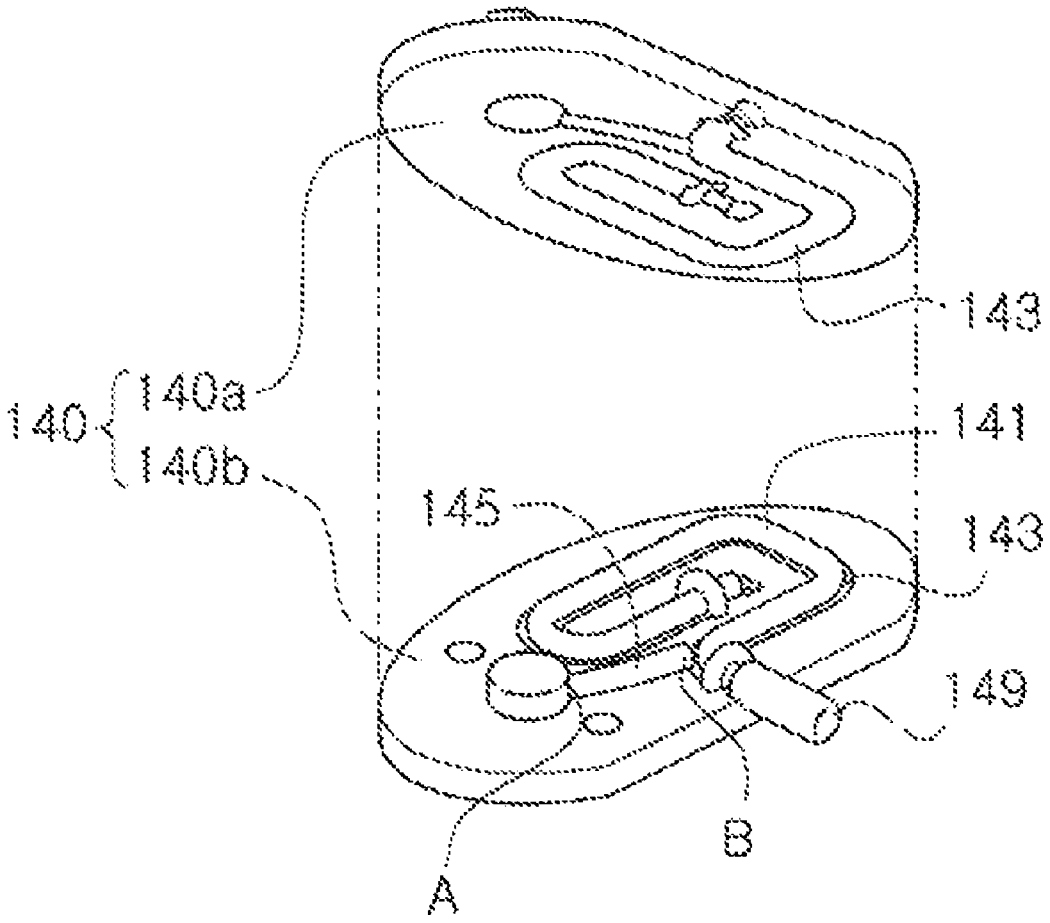
FIG. 2 is an exploded perspective view showing a cooler depicted in the cosmetics container of FIG. 1.
Figure 3:
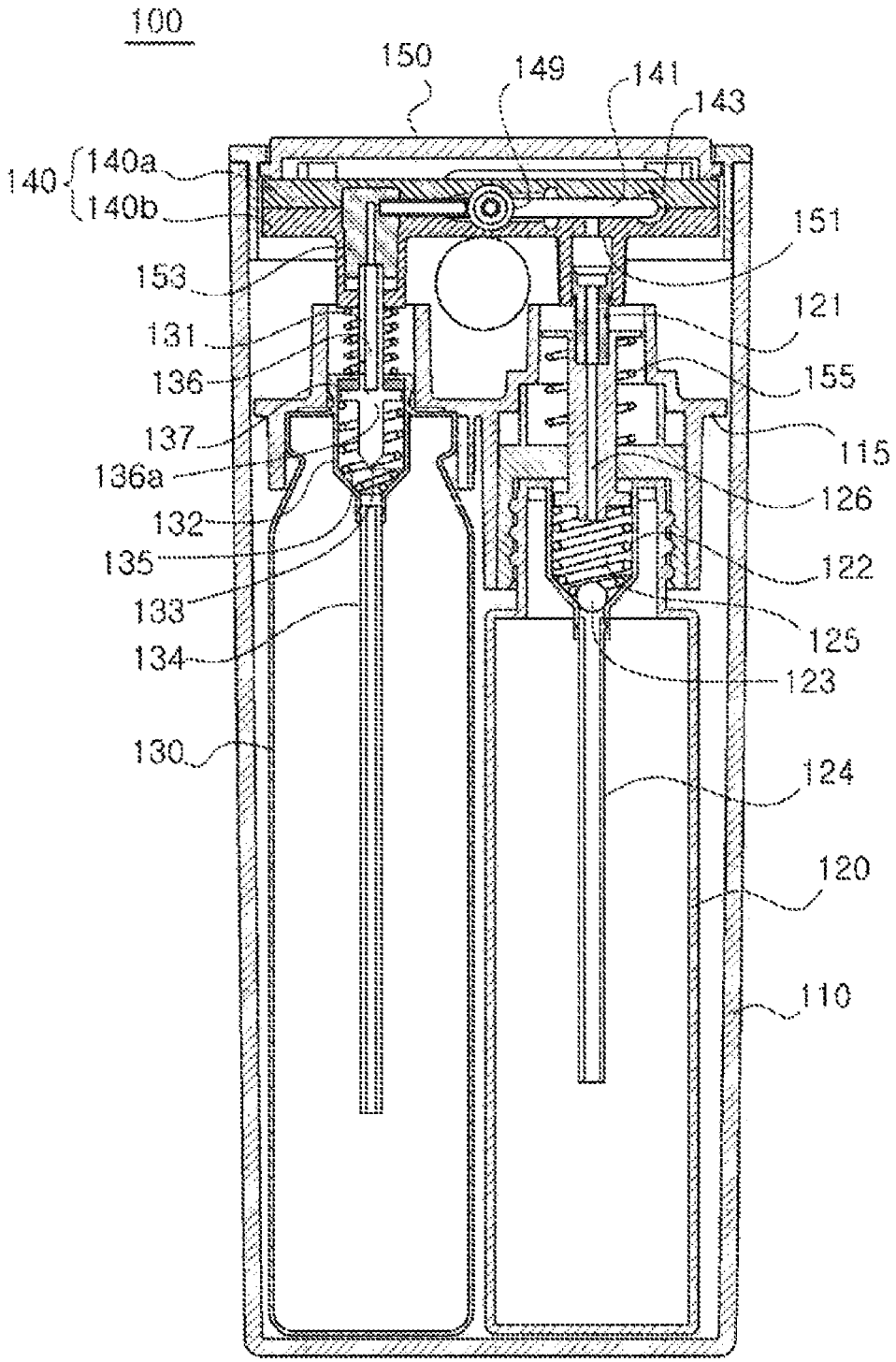
FIG. 3 is a cross-sectional view showing the cosmetics container of FIG. 1, and FIGS. 4 to 7 are diagrams for illustrating operations of the cosmetics container according to an embodiment of the present disclosure.

FIG. 1 is an exploded perspective view showing a cosmetics container according to an embodiment of the present disclosure, FIG. 2 is an exploded perspective view showing a cooler depicted in the cosmetics container of FIG. 1, and FIG. 3 is a cross-sectional view showing the cosmetics container of FIG. 1.

As shown in FIGS. 1 to 3, a cosmetics container 100 according to this embodiment includes a first container 120 configured to discharge a predetermined amount of cosmetics by a pressing motion, a second container 130 configured to discharge a predetermined amount of coolant by a pressing motion, a container 110 including the first container 120 and the second container 130 therein, a cooler 140, which includes a cooling pipe 141 connected to the first container 120 and allows the cosmetics to move therein and a cooling channel 143 formed to surround the cooling pipe 141 and connected to the second container 130 so that the coolant in the cooling channel 143 is evaporated while moving along an outer surface of the cooling pipe 141 to cool the cosmetics, and a pushing member 150 provided at one side of the container 110, wherein when the pushing member 150 is pressed to a predetermined depth, the coolant discharges from the second container 130 and moves to the cooling channel 143, and when the pushing member 150 is pressed over the predetermined depth, the cosmetics discharges from the first container 120 and moves to the cooling pipe 141, wherein the cooling pipe 141 and the cooling channel 143 extend on a plane perpendicular to a vertical direction of the container 110.

The first container 120 is a case for accommodating cosmetics and discharges a predetermined amount of cosmetics by a pressing motion. In detail, if the first discharging member 121 is pressed, cosmetics is discharged through the cosmetics outlet tube 126. For example, as shown in (b) of FIG. 4, before the first discharging member 121 is pressed, the first cylinder 122 is filled with cosmetics, and a ball 123 doses a cosmetics inlet tube 124. After that, as shown in (b) of FIG. 6, if the first discharging member 121 is pressed by a pressing motion, a first spring 125 is compressed, and the cosmetics is discharged through the cosmetics outlet tube 126. After that, as shown in (b) of FIG. 7, if the pressing motion is released, the first spring 125 is restored to its original state, and the inner pressure of the first cylinder 122 is lowered. Therefore, the ball 123 moves upwards to open the cosmetics inlet tube 124, so that the first cylinder 122 is filled with cosmetics again. However, the above process is just an example, and the first discharging member 121 is not limited thereto but may be substituted with any means capable of discharging cosmetics by a pressing motion.

The second container 130 is a case for accommodating a coolant and discharges a predetermined amount of coolant by a pressing motion. In detail, if the second discharging member 131 is pressed, a coolant is discharged through a coolant outlet tube 136. For example, as shown in (a) of FIG. 4, before the second discharging member 131 is pressed, the second cylinder 132 is filled with a coolant, and a discharge hole 136*a* formed in the coolant outlet tube 136 is exposed out of the second container 130. After that, as shown in (a) of FIG. 5 and (a) of FIG. 6, if the second discharging member 131 is pressed, a second spring 135 is compressed so that a load 133 closes a coolant inlet tube 134, and the discharge hole 136*a* moves to the inside of the second container 130 so that the coolant is discharged through the coolant outlet tube 136. After that, as shown in (a) of FIG. 7, if the pressing motion is released, the second spring 135 is restored to its original state so that the discharge hole 136*a* is exposed out of the second container 130, and the second cylinder 132 is filled with a coolant. However, the above process is just an example, and the second discharging member 131 is not limited thereto but may be substituted with any means capable of discharging a coolant by a pressing motion. Meanwhile, the kind of the coolant accommodated in the second container 130 is not specially limited, but may be HFC152a or LPG with a great evaporative latent head in order to effectively cooling cosmetics.

As shown in FIG. 1, the container 110 includes the first container 120 and the second container 130 therein and may be made of an ABS resin (acrylonitrile butadiene styrene copolymer), which is a styrene resin composed of three components: styrene, acrylonitrile and butadiene. Here, an inner shoulder 115 may be provided at the container 110 to fix the first container 120 and the second container 130. Meanwhile, the container 110 may include therein the cooler 140, which has the cooling pipe 141 and the cooling channel 143, in addition to the first container 120 and the second container 130, and the pushing member 150 may be provided at an outer side of the container 110 to be supported by the outer shoulder 117.

The cooler 140 plays a role of cooling cosmetics by using a coolant and includes the cooling pipe 141 and the cooling channel 143. Here, the cooling pipe 141 is spaced apart from the cosmetics outlet tube 126 of the first container 120 and is connected thereto by a pressing motion of a user. Therefore, if a predetermined amount of cosmetics is discharged from the first container 120 by a pressing motion, the cosmetics moves to the inside of the cooling pipe 141. The cosmetics moving into the cooling pipe 141 as described above is cooled by the coolant and then discharged out through an exhaust tip 149 so as to be used by the user. In addition, the cooling channel 143 is formed to surround the cooling pipe 141. In other words, the cooling channel 143 forms a double tube together with the cooling pipe 141, and based on its section, the cooling channel 143 and the cooling pipe 141 are concentric. Meanwhile, the cooling channel 143 is connected to the coolant outlet tube 136 of the second container 130. Therefore, if a predetermined amount of coolant is discharged from the second container 130 by a pressing motion, the coolant moves into the cooling channel 143. The coolant moving to the cooling channel 143 as described above is evaporated while moving along the outer surface of the cooling pipe 141. Due to the evaporative latent heat generated by evaporation of the coolant, the cosmetics moving to the cooling pipe 141 loses heat and is thus cooled. However, since the coolant outlet tube 136 of the second container 130 and the cosmetics outlet tube 126 of the first container 120 are structurally spaced apart from each other by a predetermined interval (see FIG. 3), the cooling channel 143 may be formed not to directly surround the cooling pipe 141 (see FIG. 2). For example, the cooling channel 143 may extend from one end A connected to the coolant outlet tube 136 of the second container 130 to a predetermined point B, and then extend while surrounding the cooling pipe 141 after the predetermined point B. In this case, the coolant is evaporated while moving from one end A of the coolant channel 143 to the predetermined point B, and thus substantially the cooling performance of the coolant may deteriorate when coming into contact with the cooling pipe 141. However, the cosmetics container 100 of this embodiment may include a cooling gas guiding pipe 145 to prevent the cooling performance of the coolant from deteriorating. In detail, since the cooling gas guiding pipe 145 extends from one end A of the cooling channel 143 to the predetermined point B and has a diameter smaller than the cooling channel 143 so that the coolant may maintain a constant pressure, it is possible to prevent the coolant from being evaporated till the predetermined point B of the cooling channel 143. Therefore, since the coolant moves till the predetermined point B, which encounters the cooling pipe 141, in a liquid state through the cooling gas guiding pipe 145, it is possible to enhance the cooling performance further.

In addition, if a coolant is discharged to the cooling channel 143 and also cosmetics is simultaneously discharged to the cooling pipe 141, the cosmetics exhausts through the exhaust tip 149 before the cooling pipe 141 is sufficiently cooled, which may deteriorate the cooling performance. In particular, cosmetics remaining at the exhaust tip 149 is substantially not cooled since it is instantly discharged by a pressing motion of the user. Therefore, in the cosmetics container 100 of this embodiment, by a single pressing motion, a coolant is firstly discharged from the second container 130 and moves to the cooling channel 143, and then cosmetics is discharged from the first container 120 and moves to the cooling pipe 141. As a result, the cooling channel 143 is sufficiently filled with the coolant so that the cooling pipe 141 is cooled, and then the cosmetics moves to the cooling pipe 141, which may realize excellent cooling performance without any separate standby time. The operation of the pushing member 150 for discharging a coolant and cosmetics in order by a single pressing motion will be described later. Meanwhile, a direction in which cosmetics moves in the cooling pipe 141 and a direction in which a coolant moves in the cooling channel 143 may be identical to each other (Co-Current Type) or opposite to each other (Counter-Current Type). Here, if a moving direction of the cosmetics and a moving direction of the coolant are opposite to each other, the cosmetics encounters a coolant at a lowest temperature just before discharging out through the exhaust tip 149, which is advantageous in enhancing the cooling performance. In addition, the cooler 140 is not specially limited but may have two synthetic resin plates 140*a*, 140*b* disposed to face each other. At this time, the synthetic resin plates 140*a*, 140*b* may be made of synthetic resin such as an ABS resin, and two synthetic resin plates 140*a*, 140*b* may be firmly adhered to each other by means of ultrasonic waves or adhesives. Meanwhile, the cooling channel 143 may be formed by pattern so that the cooler 140 is caved in. In particular, if the cooler 140 is formed with two synthetic resin plates 140*a*, 140*b*, the patterning process may be performed so that the synthetic resin plates 140*a*, 140*b* respectively correspond to the cooling channel 143 (see FIG. 2). In addition, the cooling pipe 141 and the cooling channel 143 may have at least one bent portion to form a complicated shape, which may ensure a relatively wide heat transfer area in a narrow space. Meanwhile, the cooling pipe 141 and the cooling channel 143 extend on a plane perpendicular to a vertical direction of the container 110. Therefore, a vertical length of the cooler 140 may be reduced, which advantageously allows a compact design of the cosmetics container 100 as a whole. Additionally, an elastic member 155 such as a spring (see FIG. 3) may be provided between the cooler 140 and the first and second containers 120, 130 so that the pushing member 150 is restored to its original location if a pressing motion is released.

The pushing member 150 is pushed by a pressing motion of a user to discharge cosmetics from the first container 120 and also discharges a coolant from the second container 130. Here, the pushing member 150 is, for example, formed to have a shape corresponding to a cross-section of the container 110 and provided to be inserted into an upper side of the container 110. At this time, the cooler 140 is provided below the pushing member 150, and thus if the pushing member 150 is pressed, the cooler 140 moves downwards together with the pushing member 150. In addition, a first pressing unit 151 and a second pressing unit 153 are respectively formed at the cooler 140, and thus if the cooler 140 moves downwards by the pushing member 150, the first pressing unit 151 and the second pressing unit 153 respectively presses the first discharging member 121 and the second discharging member 131. In detail, the first pressing unit 151 presses the first discharging member 121 to discharge cosmetics, and the second pressing unit 153 presses the second discharging member 131 to discharge a coolant. However, the second pressing unit 153 is directly connected to the second discharging member 131, but the first pressing unit 151 is spaced apart from the first discharging member 121 by a predetermined interval. Therefore, if the pushing member 150 is pressed, the second pressing unit 153 instantly presses the second discharging member 131 to discharge a coolant. However, the first pressing unit 151 presses the first discharging member 121 to discharge cosmetics if the pushing member 150 is pressed over a predetermined depth. As a result, while the pushing member 150 is pressed to the predetermined depth, a coolant is discharged from the second container 130 and moves to the cooling channel 143, and after that, if the pushing member 150 is pressed over the predetermined depth, cosmetics is discharged from the first container 120 and moves to the cooling pipe 141. As described above, a coolant and cosmetics are discharged in order if a user presses the pushing member 150 one time (which is called a "dual pumping system"), and thus after the cooling channel 143 is sufficiently filled with the coolant, the cosmetics moves to the cooling pipe 141. Therefore, the cosmetics container 100 of this embodiment may realize excellent cooling performance without any separate standby time.

MODE FOR INVENTION

FIGS. 4 to 7 are diagrams for illustrating operations of the cosmetics container according to an embodiment of the present disclosure. The process of cooling cosmetics with a coolant will be described with reference to FIGS. 4 to 7.

Figure 4:
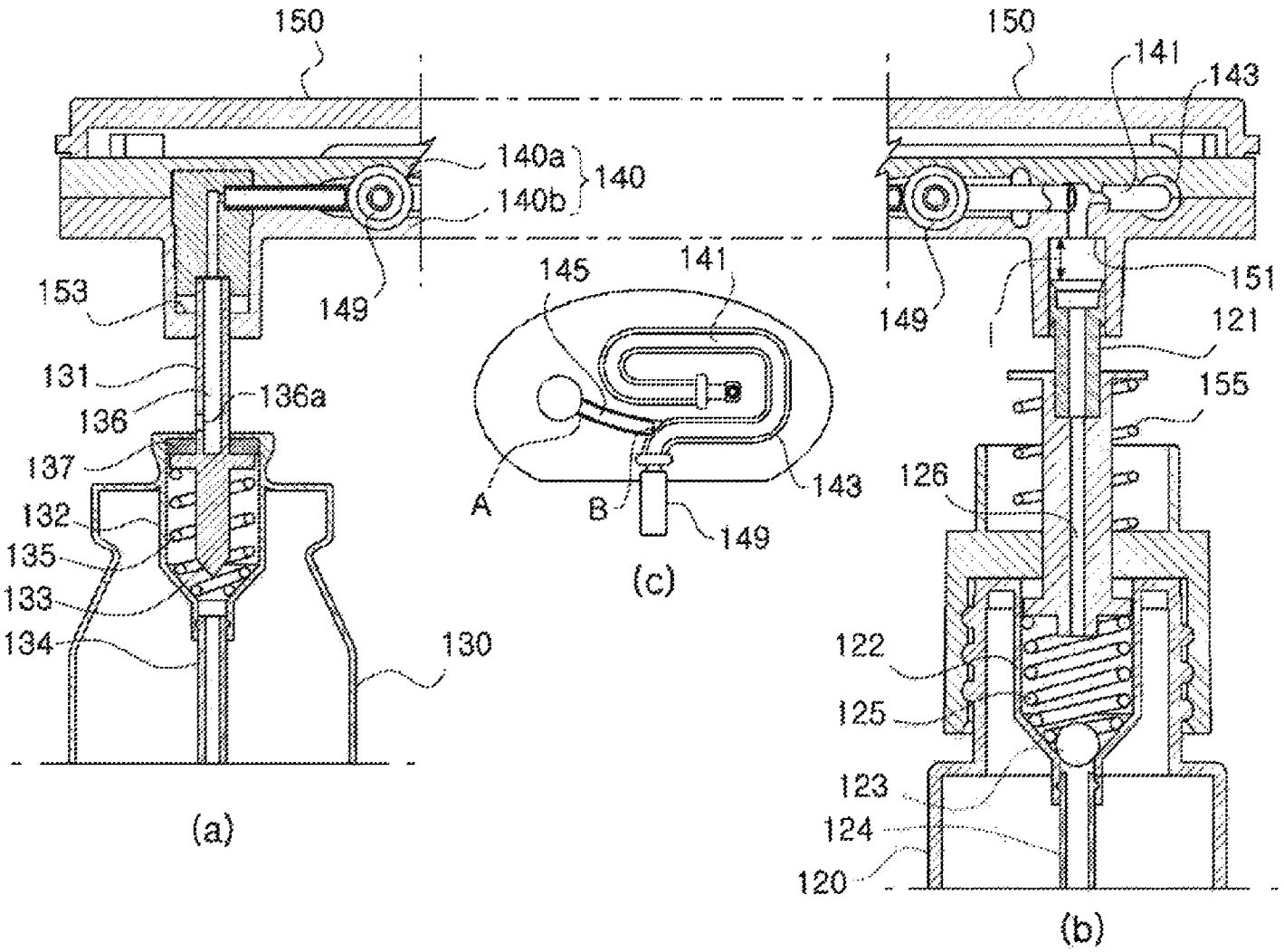
Figure 5:
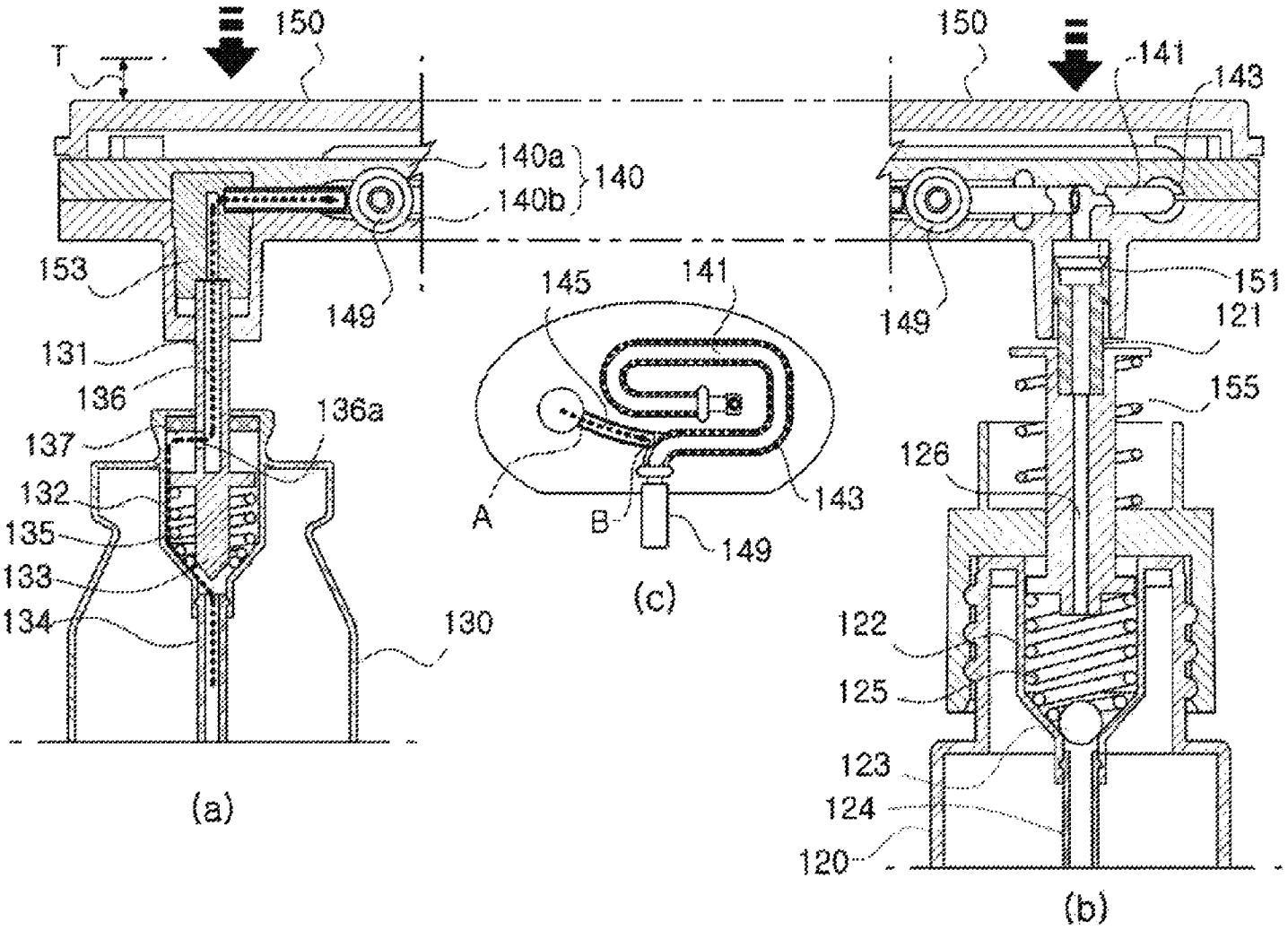

First, as shown in FIGS. 4 and 5, if the pushing member 150 is pressed to a predetermined depth T by a user, the second pressing unit 153 presses the second discharging member 131 so that a coolant is discharged from the second container 130 and moves to the cooling channel 143 (see (c) of FIG. 5). The coolant moving to the cooling channel 143 is evaporated to sufficiently cool the cooling pipe 141. In addition, cosmetics moved before may remain at the exhaust tip 149 or the like, and the coolant also cools the cosmetics remaining at the exhaust tip 149 or the like. Meanwhile, in a region from one end A of the cooling channel 143 to a predetermined point B (a point encountering the cooling pipe 141), the cooling gas guiding pipe 145 having a diameter smaller than the cooling channel 143 is provided, which may prevent the coolant from being evaporated till the predetermined point B. Therefore, the coolant encounters the cooling pipe 141 in a liquid state, and the coolant is evaporated after encountering the cooling pipe 141, thereby effectively cooling the cooling pipe 141. However, even though the pushing member 150 is pressed to the predetermined depth T, since the first pressing unit 151 is spaced apart from the first discharging member 121 by a predetermined interval I (see (b) of FIG. 4) at an initial state, the first pressing unit 151 does not press the first discharging member 121, and thus cosmetics is not discharged from the first container 120.

Figure 6:
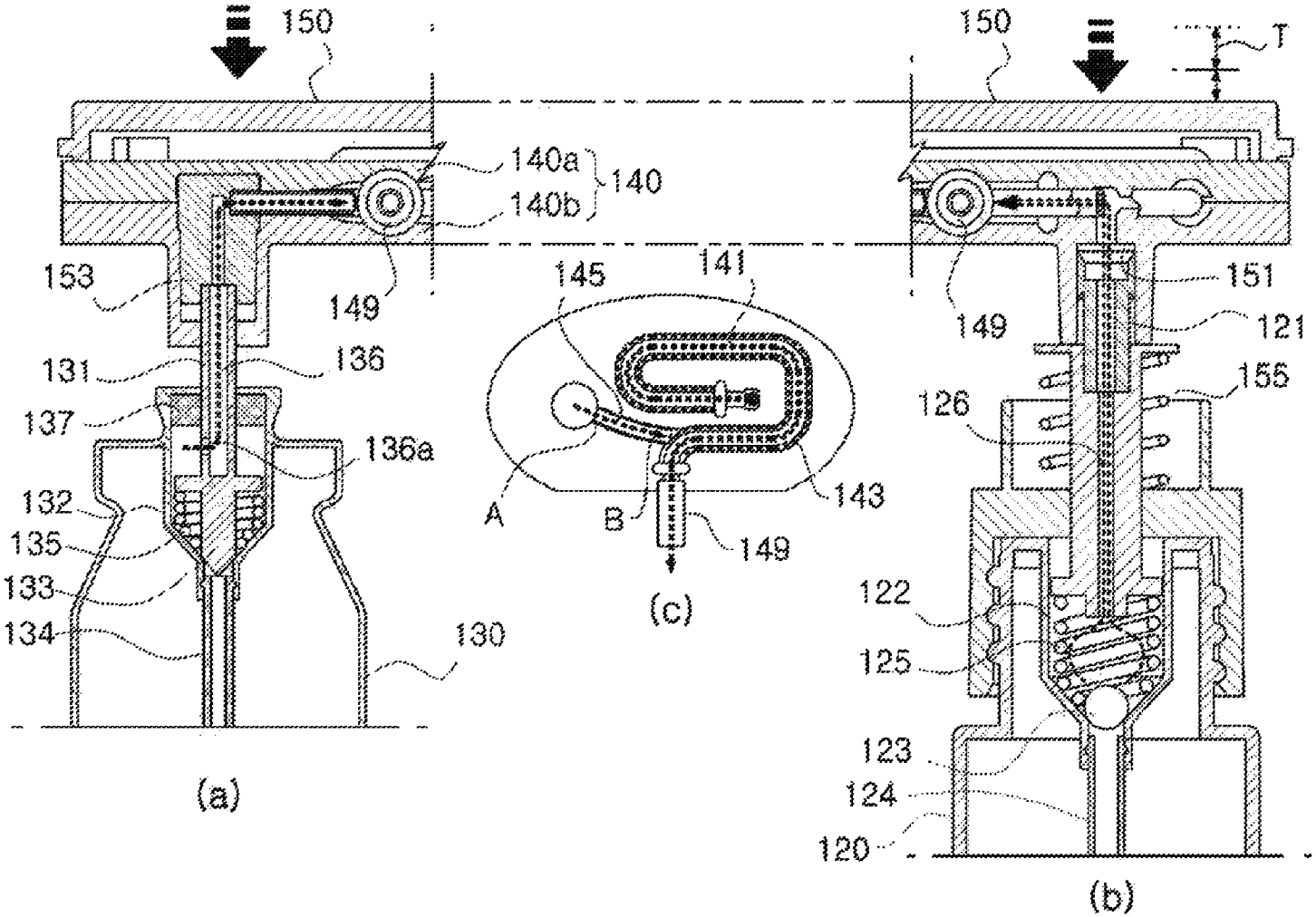

Next, as shown in FIG. 6, if the pushing member 150 is pressed over the predetermined depth T by a user, the first pressing unit 151 presses the first discharging member 121, so that cosmetics is discharged from the first container 120 and moves to the cooling pipe 141 (see (c) of FIG. 6). At this time, since the cooling pipe 141 has already been cooled by the coolant discharged from the cooling channel 143, the cosmetics may be effectively cooled while moving through the cooling pipe 141. In addition, since cosmetics remaining at the exhaust tip 149 or the like is already cooled by the coolant, if new cosmetics is discharged from the first container 120, the cosmetics remaining at the exhaust tip 149 is also discharged out in a cooled state. Therefore, the user may use sufficiently cooled cosmetics. Meanwhile, a direction in which cosmetics moves in the cooling pipe 141 and a direction in which a coolant moves in the cooling channel 143 may be opposite to each other. In this case, the cosmetics may encounter a coolant at a lowest temperature just before discharging out through the exhaust tip 149 (for example, at the predetermined point B of the cooling channel 143), which may ensure excellent cooling performance.

Figure 7:
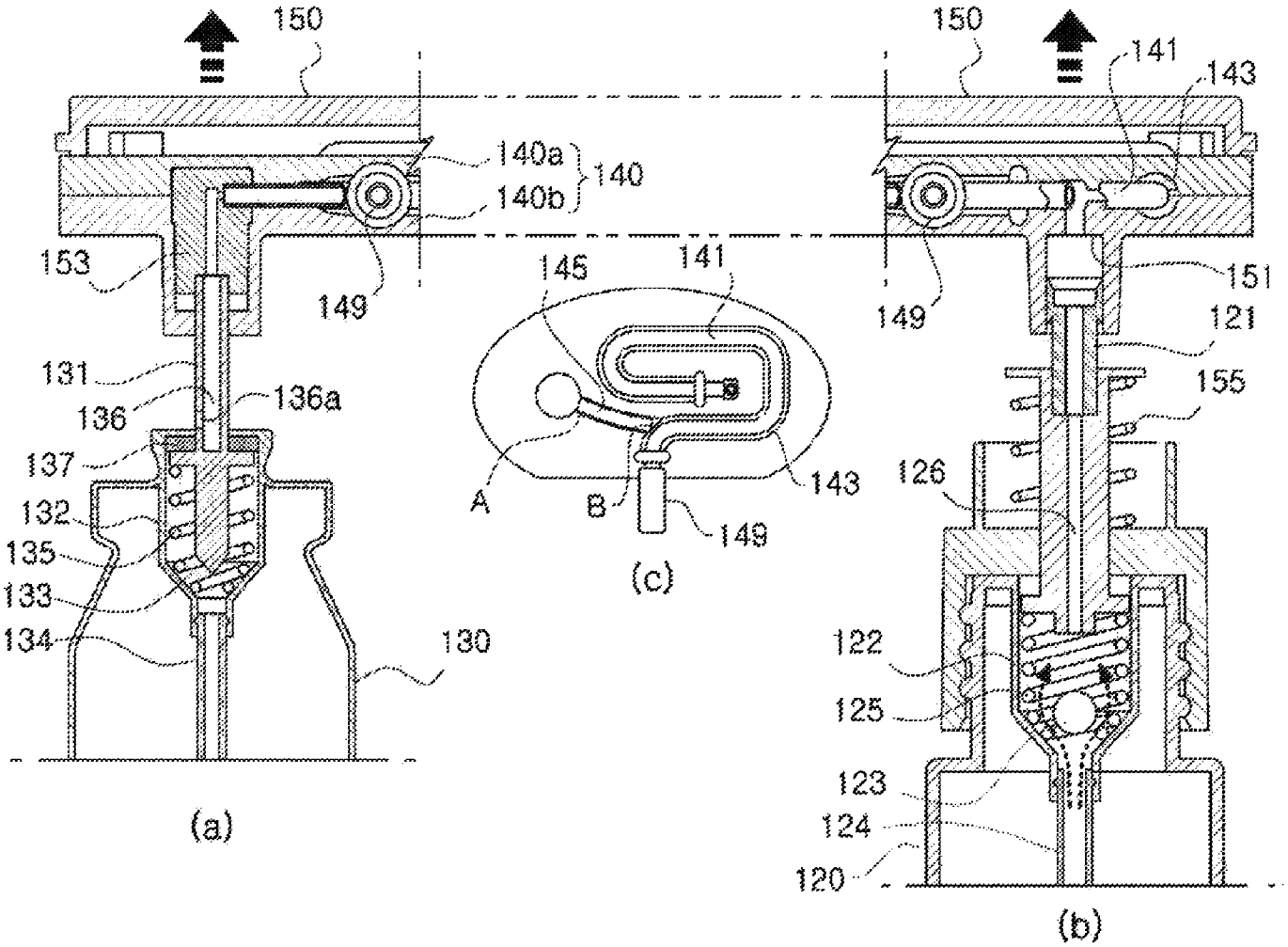

Next, as shown in FIG. 7, if the pressing motion is released, the pushing member 150 and the cooler 140 are restored to their original locations by means of the elastic member 155 provided between the cooler 140 and the first and second containers 120, 130.

Heretofore, the present disclosure has been described in detail using specific embodiments, but this is just for better understanding of the present disclosure, and the present disclosure is not limited thereto. It is obvious to those skilled in the art that various changes or modifications can be made to the present disclosure.

Such changes or modifications of the present disclosure belong to the scope of the present disclosure, and the detailed scope of protection of the present disclosure will be defined by the appended claims.

INDUSTRIAL APPLICABILITY

The present disclosure may provide a cosmetics container, which may give excellent cooling performance without any separate standby time, by moving a coolant to a cooling channel and then moving cosmetics to a cooling pipe for cooling.

The invention claimed is:

1. A cosmetics container, comprising:

a first container configured to discharge a predetermined amount of cosmetics by a pressing motion;

a second container configured to discharge a predetermined amount of coolant by a pressing motion;

a container configured to include the first container and the second container therein;

a cooler, which includes:

a cooling pipe connected to the first container and allows the cosmetics to move therein, and a cooling channel formed to surround the cooling pipe and connected to the second container, so that the coolant in the cooling channel is evaporated while moving along an outer surface of the cooling pipe to cool the cosmetics;

a pushing member provided at one side of the container, wherein when the pushing member is pressed to a predetermined depth, the coolant discharges from the second container and moves to the cooling channel, and when the pushing member is pressed over the predetermined depth, the cosmetics discharges from the first container and moves to the cooling pipe, a first discharging member provided at the first container to discharge the cosmetics by a pressing motion; and a first pressing unit spaced apart from the first discharging member by a predetermined interval and configured to press the first discharging member when the pushing member is pressed over the predetermined depth so that the cosmetics discharges, wherein the cooling pipe and the cooling channel extend on a plane perpendicular to a vertical direction of the container.

2. The cosmetics container according to claim 1, further comprising:

a second discharging member provided at the second container to discharge the coolant by a pressing motion; and a second pressing unit connected to the second discharging member and configured to press the second discharging member when the pushing member is pressed so that the coolant discharges.

3. The cosmetics container according to claim 1, wherein the cooling channel extends from one end connected to the second container to a predetermined point, and after the predetermined point, the cooling channel extends to surround the cooling pipe.

4. The cosmetics container according to claim 3, further comprising:

a cooling gas guiding pipe extending from one end of the cooling channel to the predetermined point and having a diameter smaller than the cooling channel to prevent the coolant from being evaporated till the predetermined point.

5. The cosmetics container according to claim 1, wherein a direction in which the cosmetics moves in the cooling pipe is opposite to a direction in which the coolant moves in the cooling channel.

6. The cosmetics container according to claim 1, wherein the cooling channel is formed by carving in the cooler.

7. The cosmetics container according to claim 1, wherein the cooler is formed by disposing two synthetic resin plates to face each other.

8. The cosmetics container according to claim 1, wherein the cooling pipe and the cooling channel have at least one bent portion.

* * * * *